US005524737A

United States Patent [19]

Wang

[11] Patent Number: 5,524,737

[45] Date of Patent: Jun. 11, 1996

[54] RETRACTABLE HANDLE AND WHEEL ASSEMBLY FOR TRAVEL BAGS

[76] Inventor: King-Sheng Wang, No.569, Ching Kuo Road, Ta Chia Chien, Taichung Hsien, Taiwan

[21] Appl. No.: 280,666

[22] Filed: Jul. 29, 1994

[51] Int. Cl.[6] ..... A45C 5/14; A45C 13/26; A45C 13/36

[52] U.S. Cl. ..... 190/18 A; 190/39; 190/115; 190/127; 16/115; 280/37

[58] Field of Search ..... 190/115, 117, 190/18 R, 18 A, 39, 127; 280/37, 655, 655.1, 47.315, 47.371; 16/115

[56] References Cited

U.S. PATENT DOCUMENTS

| | | | |
|---|---|---|---|
| 3,257,120 | 6/1966 | Browning | 190/18 A X |
| 4,321,727 | 3/1982 | Sheiman et al. | 190/18 A X |
| 4,340,132 | 7/1982 | Cerna | 190/18 A |
| 5,022,574 | 6/1991 | Cesari | 190/127 X |
| 5,105,919 | 4/1992 | Bomes et al. | 190/18 A |
| 5,115,895 | 5/1992 | Myers | 190/18 A |
| 5,167,306 | 12/1992 | Carrigan, Jr. | 190/18 A |
| 5,181,590 | 1/1993 | Carpenter et al. | 190/127 X |
| 5,197,580 | 3/1993 | Berman et al. | 190/127 X |
| 5,277,449 | 1/1994 | Schmidt | 280/655 |
| 5,291,976 | 3/1994 | Ku | 16/115 X |
| 5,295,565 | 3/1994 | Latshaw | 190/18 A X |
| 5,323,886 | 6/1994 | Chen | 16/115 X |
| 5,377,795 | 1/1995 | Berman | 190/18 A |

FOREIGN PATENT DOCUMENTS

| | | | |
|---|---|---|---|
| 1024109 | 1/1978 | Canada | 190/18 A |
| 1412885 | 8/1965 | France | 190/18 A |
| 1563534 | 4/1969 | France | 190/18 A |
| 2353629 | 5/1974 | Germany | 190/18 A |
| 9318684 | 9/1993 | WIPO | 190/18 A |

*Primary Examiner*—Sue A. Weaver
*Attorney, Agent, or Firm*—Bacon & Thomas

[57] ABSTRACT

A retractable handle and wheel assembly includes a flat handle mounting frame and a circularly arched wheel mounting frame joined together and mounted on the back and bottom panel of a collapsible travel bag. Two wheel holders are respectively fastened to the wheel mounting frame each wheel holder having a wheel coupling portion fitted over a respective recessed hole on the wheel mounting frame to hold a respective wheel by a bearing and a channel bar bearing block fixedly fastened to the handle mounting frame to hold a respective channel bar, with a retractable handle sliding in an out of the channel bars, the retractable handle having two rubber blocks at two adjacent ends for positioning the handle at either end of each channel bar to hold the handle in the collapsed or extended out position.

3 Claims, 5 Drawing Sheets

RETRACTABLE HANDLE AND WHEEL ASSEMBLY FOR TRAVEL BAGS

BACKGROUND OF THE INVENTION

The present invention relates to a retractable handle and wheel assembly, and relates more particularly to such a retractable handle and wheel assembly developed for use with a conventional collapsible softside travel bag.

Various collapsible travel bags are known and intensively used by travelers. A collapsible travel bag generally has a shoulder strap or carrying handle for carrying on the back or by hand. However, it is not comfortable to carry a collapsible travel bag on the back or by hand when heavy things are loaded. Because regular travel bags are collapsible, retractable handles are not suitable for such travel bags. Furthermore, regular travel bags generally have a lining board for supporting articles and bumpers for protection. Because the lining board and bumpers of a travel bag occupy much installation space, they should be properly designed to provide additional functions.

SUMMARY OF THE INVENTION

According to one aspect of the present invention, there is provided a flat handle mounting frame and a circularly arched wheel mounting frame joined together and mounted on the back and bottom panel of a collapsible travel bag to hold two channel bars for mounting a retractable handle and two wheel holders, each for mounting a respective wheel. The flat handle mounting frame also serves as the lining board of the collapsible travel bag.

According to another aspect of the present invention, there are two channel bars fastened to the handle mounting frame for holding a retractable handle and also serving as bumpers for protecting the back panel of the collapsible travel bag.

According to still another aspect of the present invention, the channel bars each have both ends reduced in inner diameter such that the retractable handle can be selectively positioned between collapsed or extended positions.

According to still another aspect of the present invention, each wheel holder has a wheel coupling portion and a bearing turned about a pivot transversely disposed in the wheel coupling portion to hold a respective wheel.

According to still another aspect of the present invention, each wheel holder has a channel bar bearing block which receives one end of the respective channel bar.

According to still another aspect of the present invention, a carrying handle is mounted on the top panel of the collapsible travel bag adjacent to the retractable handle for the holding of one hand when the retractable handle is pulled by the other hand.

DETAILED DESCRIPTION OF THE PREFERRED EMBODIMENT

Figure 1:
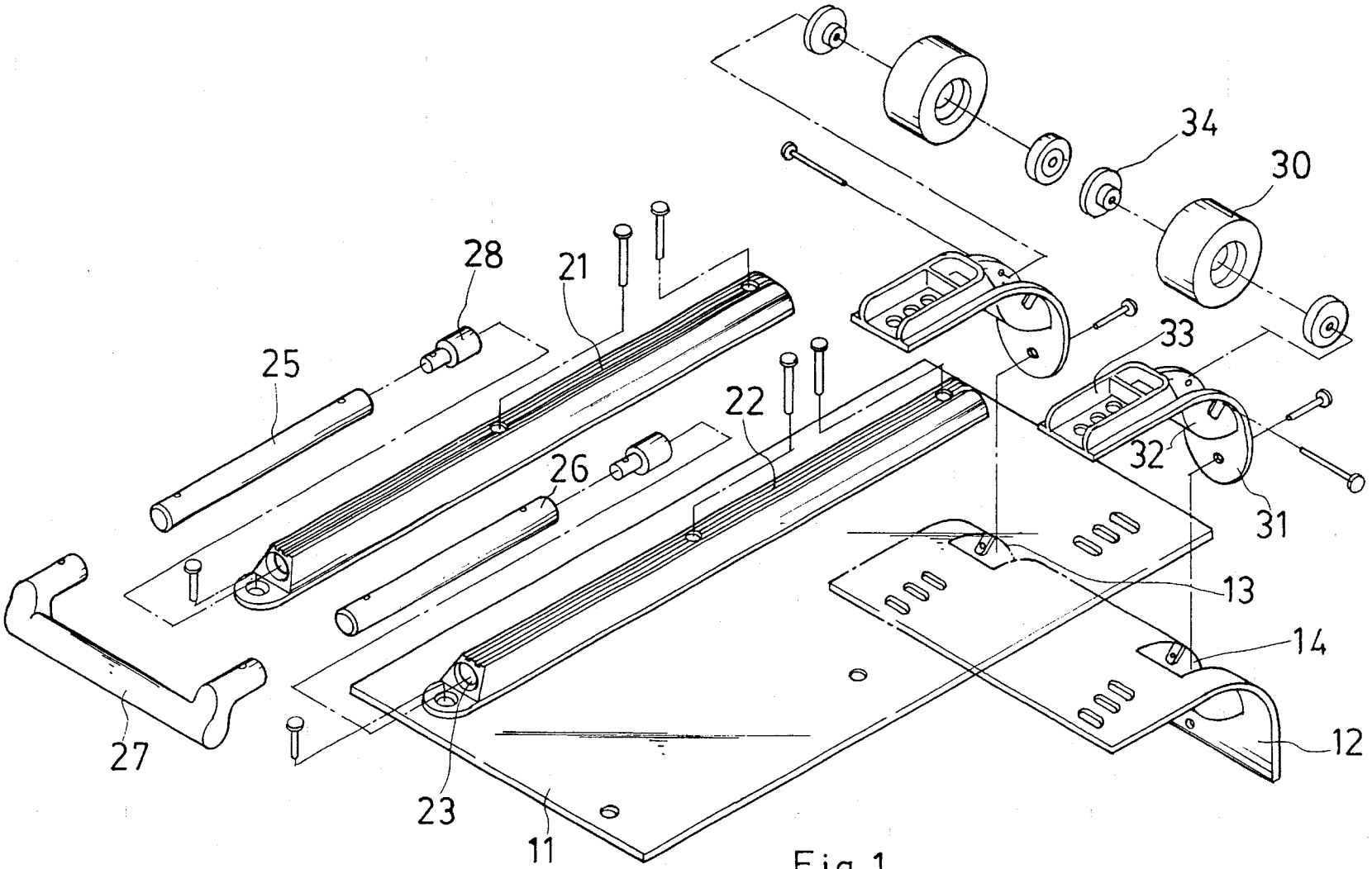
FIG. 1 is an exploded perspective view of a retractable handle and wheel assembly according to the present invention.
Figure 2:
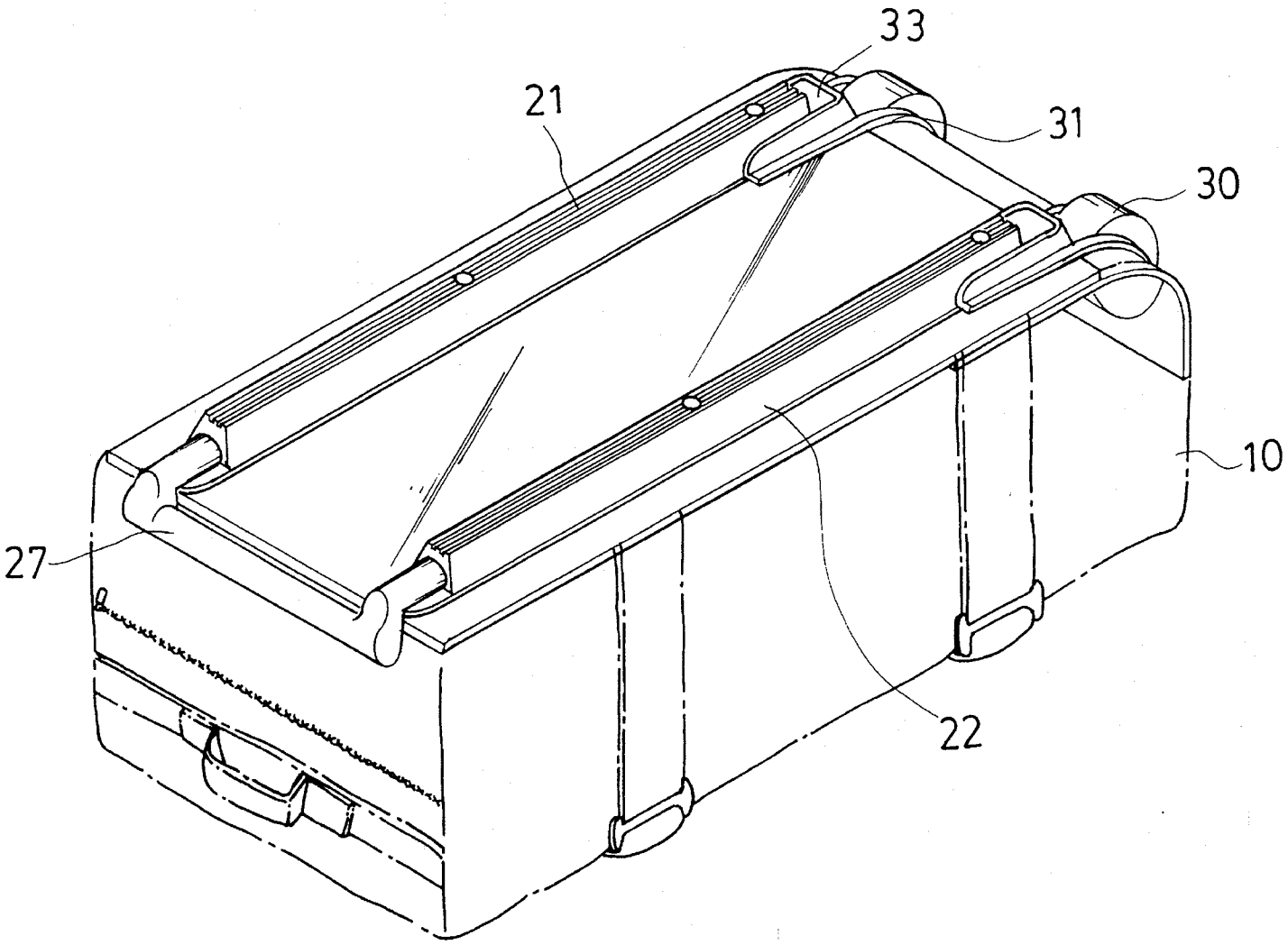
FIG. 2 is a perspective view, showing the retractable handle and wheel assembly of the present invention mounted on a travel bag.

Referring to FIGS. 1 and 2, a flat handle mounting frame 11 and a circularly arched wheel mounting frame 12 are connected together and fastened to the back and bottom panels of a travel bag 10 by rivets. The wheel mounting frame 12 has two recessed holes 13 and 14. Two wheel holders 31 are respectively fastened to the wheel mounting frame 12, each holding a respective wheel 30. Each wheel holder 31 comprises a wheel coupling portion 32 for fitting over recessed holes 13, 14 to hold the respective wheels 30. A channel bar bearing block 33 is provided in each holder 31 and fastened to the handle mounting frame 11 to hold one end of a respective channel bar 21 or 22. The channel bars 21 and 22 each have one end fixedly fastened to the bearing block 33 of each wheel holder 31 and an opposite end fixedly fastened to the handle mounting frame 11 and the back panel of the travel bag 10. Two elongated rods 25 and 26 are slidably received within the axial grooves 23 of the channel bars 21 and 22, and joined by a handgrip 27 outside the channel bars 21 and 22.

Figure 3:
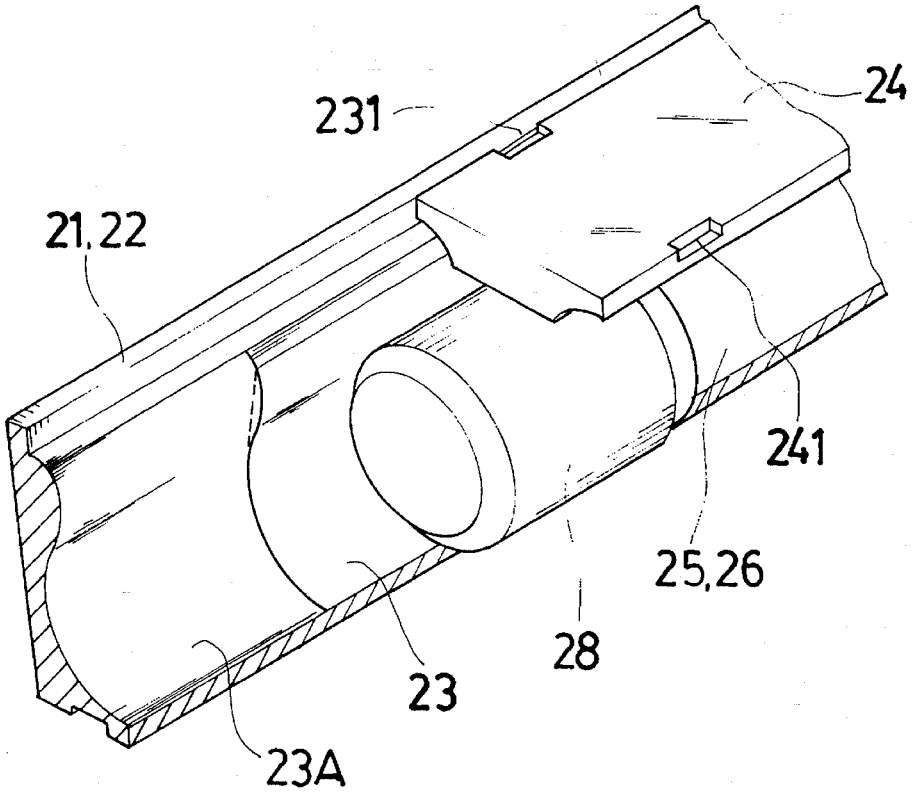
FIG. 3 is a partial cutaway view of the channel bar for the retractable handle and wheel assembly of FIG. 2, showing the positioning of the rubber block of the elongated rod.
Figure 4:
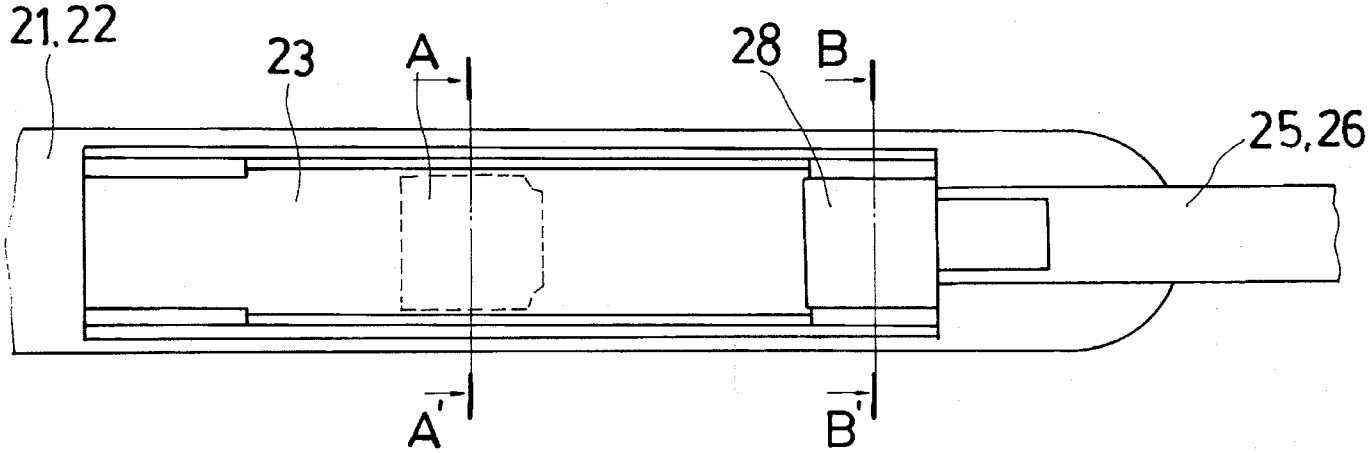
FIG. 4 is a longitudinal view of the channel bar, showing the positioning of the rubber block of the elongated rod.
Figure 4A:
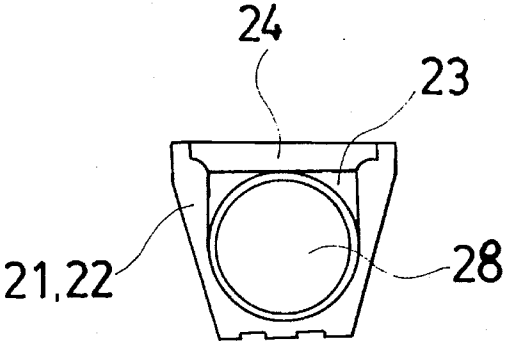
FIG. 4A is a sectional view taken along line A-A' of FIG. 4.
Figure 4B:
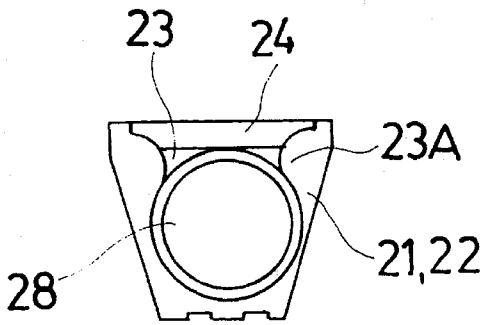
FIG. 4B is a sectional view taken along line B-B' of FIG. 4.

Referring to FIGS. 3, 4, 4A and 4B, and FIG. 1 again, the width of the axial groove 23 of each channel bar 21 or 22 is of reduced diameter portions at the two opposite ends thereof, as seen at 23A in FIGS. 3 and 4B. Each elongated rod 25 or 26 has a top end connected to the handgrip 27 and a bottom end coupled with a rubber block 28. When the elongated rods 25 and 26 are moved into or pulled out of the axial grooves 23 of the channel bars 21 and 22 by the handgrip 27, the rubber blocks 28 become retained in position against portions 23A to hold the retractable handle, latter defined by the elongated rods 25 and 26 and the handgrip 27, in the collapsed or extended out position. The axial groove 23 of the channel bar 21 or 22 is covered with a cover board 24. The cover board 24 has a plurality of retaining notches 241. The channel bar 21 or 22 has a plurality of retaining projections 231 which respectively engage the retaining notches 241 on the cover board 24.

Figure 5:
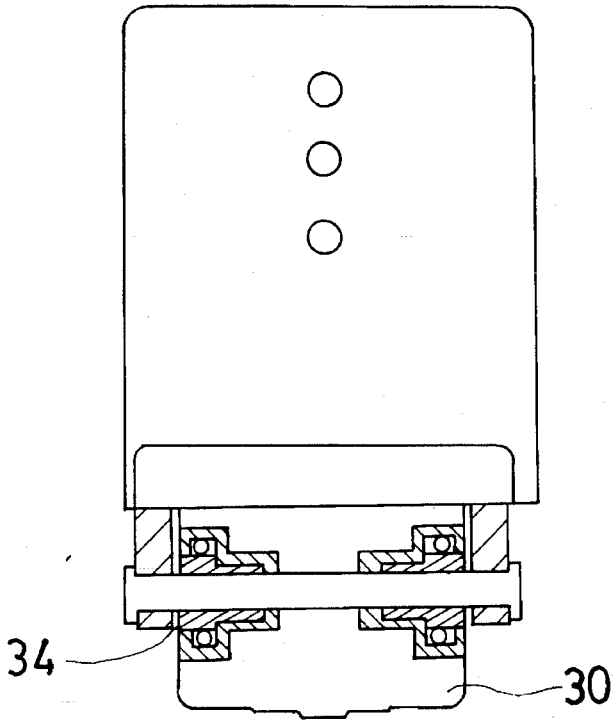
FIG. 5 is a plan view showing a wheel turned about a bearing mounted on a wheel holder according to the present invention.

Referring to FIG. 5, the wheel 30 is supported on a bearing 34 pivotally mounted within the wheel coupling portion 32 of each wheel holder 31. Therefore, the wheel 30 can be moved on the ground smoothly.

Figure 6:
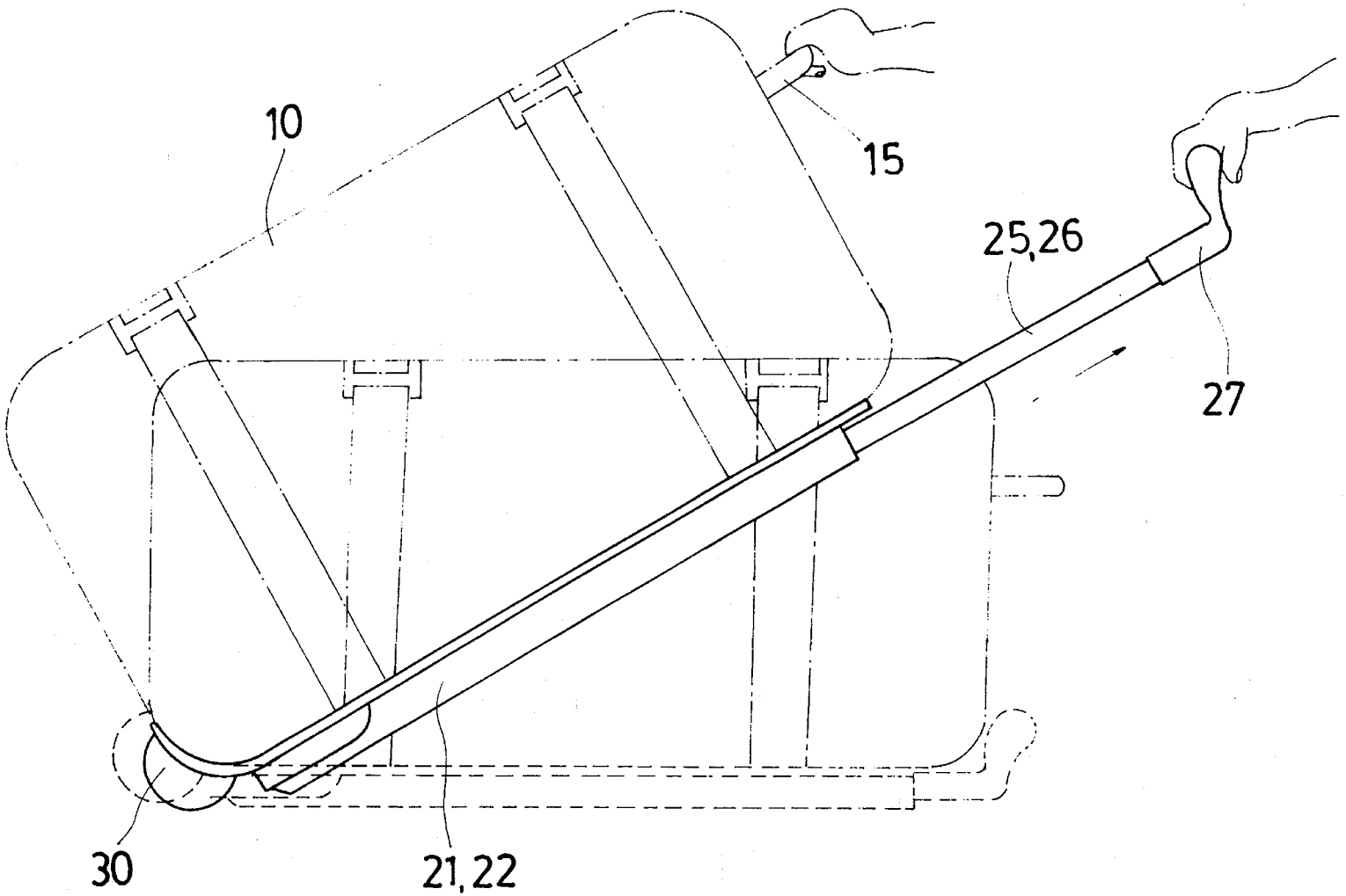
FIG. 6 is plan view of FIG. 2, showing the retractable handle pulled out of the channel bars into the working position.

Referring to FIG. 6, the travel bag 10 comprises a carrying handle 15 disposed at a location adjacent to the retractable handle (the handgrip 27). Therefore, the user can easily pull the retractable handle out of the channel bars 21 and 22 by holding the carrying handle 15 with one end and pulling the handgrip 27 with the other hand.

I claim:

1. A retractable handle and wheel assembly for a collapsible travel bag of the type including back and bottom panels, the assembly comprising:

a) a flat frame attached to the back panel externally of the collapsible travel bag, the flat frame covering substantially the entire area of the back panel to serve as a stiffener for the bag;

b) a curved wheel frame attached to the bottom panel of the travel bag and to the flat frame, the wheel frame including a pair of spaced recesses;

c) a pair of wheel holders mounted on the curved wheel frame, each wheel holder including a coupling portion engaged with a recess of the wheel frame and a bearing block overlapping a portion of the flat frame;

d) a pair of channel bars located externally of the collapsible bag, each channel bar having one end secured to the bearing block of a wheel holder and an opposite end secured to the flat frame and the back panel of the travel bag, an axial groove, and a cover board covering the groove so as to act as a stiffener and a bumper for the collapsible bag;

e) a handle including a hand grip and a pair of rods, the rods being slidably received within the axial grooves of the channel bars, each rod including a free end positioned within the channel bar and a rubber block secured to the free end, and means disposed within each channel bar for engagement by the rubber blocks for retaining the handle in either a fully extended or a fully retracted position; and f) a wheel rotatably secured to the coupling portion of each wheel holder.

2. The assembly of claim 1 wherein the means disposed within each channel bar for retaining the handle includes a reduced diameter portion in the axial groove engageable by the rubber block.

3. The assembly of claim 1 wherein each wheel holder further includes a pivotal transverse bearing and each wheel being mounted on the bearing.

* * * * *